US006688220B2

(12) United States Patent
Ohno

(10) Patent No.: US 6,688,220 B2
(45) Date of Patent: Feb. 10, 2004

(54) STENCIL PRINTER

(75) Inventor: Katsumi Ohno, Inashiki-gun (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 10/326,260

(22) Filed: Dec. 23, 2002

(65) Prior Publication Data

US 2003/0121431 A1 Jul. 3, 2003

(30) Foreign Application Priority Data

Dec. 26, 2001 (JP) ..... 2001-394515

(51) Int. Cl.[7] ..... B41C 1/14
(52) U.S. Cl. ..... 101/128.4; 101/116
(58) Field of Search ..... 101/114, 115, 101/116, 117, 118, 119, 120, 123, 128.4, 129

(56) References Cited

U.S. PATENT DOCUMENTS 4,916,486 A 4/1990 Nakatani

OTHER PUBLICATIONS

Patent Abstract Of Japan, vol. 012, No. 112 (P–687), Apr. 9, 1988, JP 62 240976, Oct. 21, 1987.

European Search Report, Dated Mar. 18, 2003.

*Primary Examiner*—Ren Yan
(74) *Attorney, Agent, or Firm*—Nixon Peabody LLP; Donald R. Studebaker

(57) ABSTRACT

A stencil printer is linked with a non-stencil printer. A number of copies to be printed is set. Working mode of the stencil printer is set to a stencil making mode or an ink transfer mode. A stencil is made when the working mode of the stencil printer is set to the stencil making mode and ink is transferred to a printing paper through the stencil when the stencil printer is set to the ink transfer mode. When the number of copies set is not smaller than a predetermined threshold value, the stencil printer is used, and when the number of copies is smaller than the predetermined threshold value, the non-stencil printer is used. Switching between the stencil printer and the non-stencil printer is inhibited when the working mode of the stencil printer is the ink transfer mode.

1 Claim, 4 Drawing Sheets

STENCIL PRINTER

BACKGROUND OF THE INVENTION

1. Field of the Invention

This invention relates to a stencil printer, and more particularly to a stencil printer which can be linked with another printer which prints in a system other than the stencil printing.

2. Description of the Related Art

The stencil printer generally comprises a stencil making section which makes a stencil (imagewise perforates a stencil material) on the basis of bit map data obtained by reading an original by a built-in image reading means such as an image scanner or by expanding PDL (page description language) data sent from a computer or the like and an ink transfer section which transfers ink to printing papers through a stencil wound around a printing drum. Generally, the stencil printer is automatically set to the stencil making mode each time it receives a piece of PDL data or each time the built-in image reading means begins to read the image on an original, and the stencil making section starts to make a stencil. When the stencil making section finishes making a stencil, the working mode of the stencil printer is automatically switched to the ink transfer mode and the ink transfer section makes a desired number of copies by the use of the stencil made by the stencil making section. The working mode of the stencil printer is kept set to the ink transfer mode even a series of printing is finished until another piece of PDL data is sent thereto or another original is set. When only the number of copies to be additionally printed is set and the stencil printer is activated in this state, the stencil making section does not work and the ink transfer section makes desired number of additional copies by the use of the stencil which have been on the printing drum (additional printing).

There are employed in an office or the like various types of printers such as a laser beam printer, an ink jet printer, a dot printer and the like as well as a stencil printer.

These printers work in different printing systems. For example, the stencil printer makes a stencil and prints by transferring ink to printing papers through the stencil, whereas, in printers other than the stencil printer, no stencil is used. For example, in the case of a laser beam printer, a photosensitive drum is imagewise exposed to a laser beam, toner is caused to adhere to the exposed part of the photosensitive drum, and the toner on the photosensitive drum is transferred to a printing paper, and these steps are repeated for each copy.

Since these printers work in different printing systems, the time and/or cost required to output one copy greatly differs from each other depending on the type of the printer.

The following table 1 shows the time and cost required to output one copy in the case of a stencil printer (SP) versus the time and cost required to output one copy in the case of a laser beam printer (LBP) when the stencil printer and the LBP outputs output the same copies.

TABLE 1

| | printer | | | |
|---|---|---|---|---|
| | output time/one copy | | cost/one copy | |
| number of copies | SP | LBP | SP | LBP |
| 1 | 60.0 [s] | 5.0 [s] | ¥160 | ¥10 |
| 20 | 3.6 [s] | 5.0 [s] | ¥8 | ¥10 |
| 100 | 1.2 [s] | 5.0 [s] | ¥7 | ¥10 |
| 500 | 0.7 [s] | 5.0 [s] | ¥6 | ¥10 |
| 1000 | 0.7 [s] | 5.0 [s] | ¥5 | ¥10 |
| 3000 | 0.6 [s] | 5.0 [s] | ¥4 | ¥10 |

As can be understood from table 1, in the case of the stencil printer, the output time per one copy is shortened as the total number copies to be printed increases and the cost per one copy is reduced as the total number copies to be printed increases since it is necessary to make a stencil and to wind the stencil around the printing drum irrespective of the number of copies to be printed. On the other hand, in the case of the laser beam printer, the output time per one copy and the cost per one copy are both constant irrespective of the number of copies to be printed. Accordingly, the stencil printer is advantageous over the laser beam printer (or other printers) when the total number of copies to be printed (of the same contents) is large whereas the laser beam printer (or other printers) is advantageous over the stencil printer when the total number of copies to be printed (of the same contents) is small.

There has been proposed, as disclosed in Japanese Unexamined Patent Publication No. 1(1989)-217384, a system in which a stencil printer and one or more non-stencil printer (a printer which works in a printing system different from the stencil printer) are linked and the stencil printer is used when the number of copies to be printed is large, whereas the non-stencil printer is used when the number of copies to be printed is small.

However, this system involves a problem that when a small number of additional copies are to be printed and the system is activated with only the number of additional copies set, the non-stencil printer is selected and additional copies are printed by the non-stencil printer, although a large number of the same copies have been printed by the stencil printer and the stencil is still wound around the printing drum, that is, although use of the stencil printer is advantageous over use of the non-stencil printer from the viewpoint of both the cost and the quality of the printings. That is, there is a demand that additional copies should be printed by the stencil printer irrespective of the number thereof in the case where the stencil is still on the printing drum.

SUMMARY OF THE INVENTION

In view of the foregoing observations and description, the primary object of the present invention is to provide a stencil printer which can be linked with a non-stencil printer so that print is made by the stencil printer when the number of copies to be printed is not smaller than a predetermined value and print is made by the non-stencil printer when the number of copies to be printed is smaller than the predetermined value and at the same time print is made by the stencil printer irrespective of the number of copies when copies of the same contents as those printed by the use of the stencil on the printing drum of the stencil printer are to be additionally printed.

The object can be accomplished by a stencil printer which can be linked with a non-stencil printer comprising a copy number setting means for setting a number of copies to be printed, a working mode setting means for setting the working mode of the stencil printer to a stencil making mode or an ink transfer mode, a stencil printing means consisting of a stencil making section which makes a stencil when the working mode of the stencil printer is set to the stencil making mode by the working mode setting means and an ink transfer section which transfers ink to a printing paper through the stencil made by the stencil making section when the working mode of the stencil printer is set to the ink transfer mode by the working mode setting means, and a printer switching means which causes the stencil printing means to print when the number of copies set by the copy number setting means is not smaller than a predetermined threshold value and causes the non-stencil printer to print when the number of copies set by the copy number setting means is smaller than the predetermined threshold value, wherein the improvement comprises a switching inhibiting means which inhibits the printer switching means from switching between the stencil printing means and the non-stencil printer when the working mode of the stencil printer is the ink transfer mode.

The "working mode setting means" automatically sets the working mode of the stencil printer to a stencil making mode each time it receives a piece of PDL data or each time the built-in image reading means begins to read the image on an original and to the ink transfer mode when the stencil making section finishes making a stencil. It is preferred that the working mode setting means can be manually operated to set the working mode of the stencil printer to the stencil making mode or to the ink transfer mode.

The stencil printer in accordance with the present invention may be contained in a housing separate from that of the non-stencil printer and connected with the non-stencil printer through an external interface such as a LAN cable or a parallel cable, or may be contained in a housing together with the non-stencil printer and connected with the non-stencil printer through an internal interface.

In accordance with the stencil printer of this invention, the stencil printer and the non-stencil printer can be selectively used according to the number of copies to be printed. At the same time, the stencil printer can be used irrespective of the number of copies to be additionally printed so long as the stencil for the copies is still wound around the printing drum, whereby additional copies can be printed at lower cost.

DESCRIPTION OF THE PREFERRED EMBODIMENTS

Figure 1:
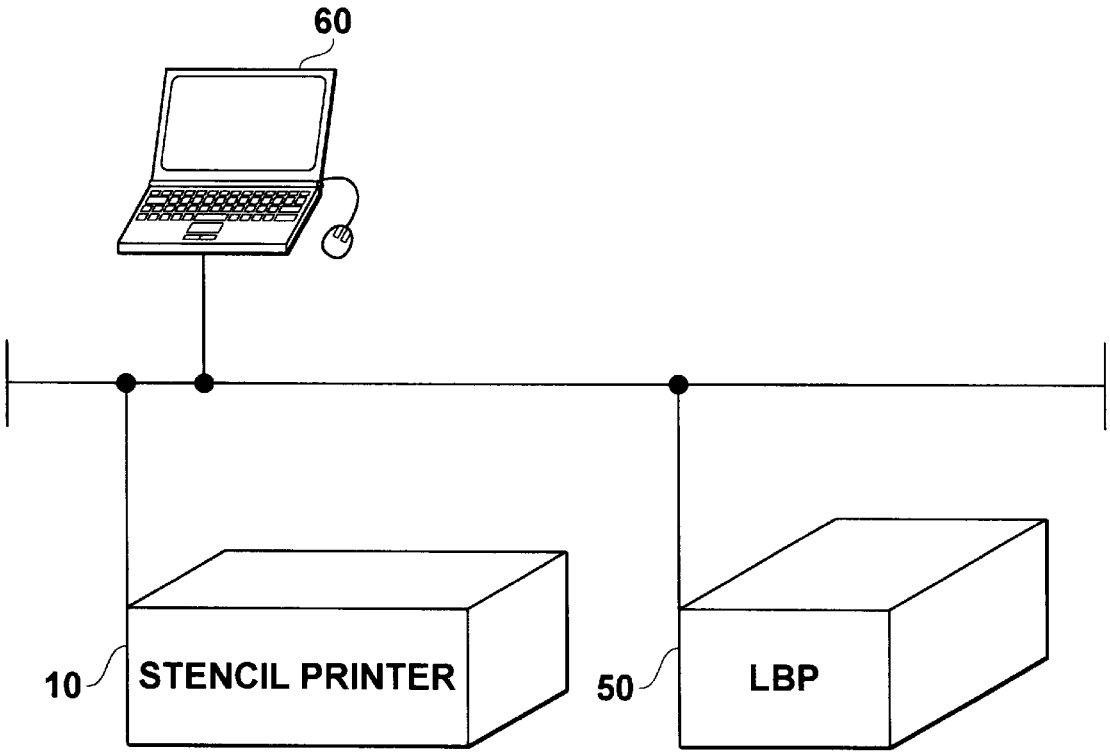
FIG. 1 is a view schematically showing a print system including a stencil printer in accordance with an embodiment of the present invention.

In FIG. 1, a print system comprises a stencil printer 10 in accordance with an embodiment of the present invention, a laser beam printer 50 and a computer 60 which are connected by way of a network. A printer driver for the stencil printer 10 is installed in the computer 60 and the computer 60 sends PDL data Pa to the stencil printer 10.

Figure 2:
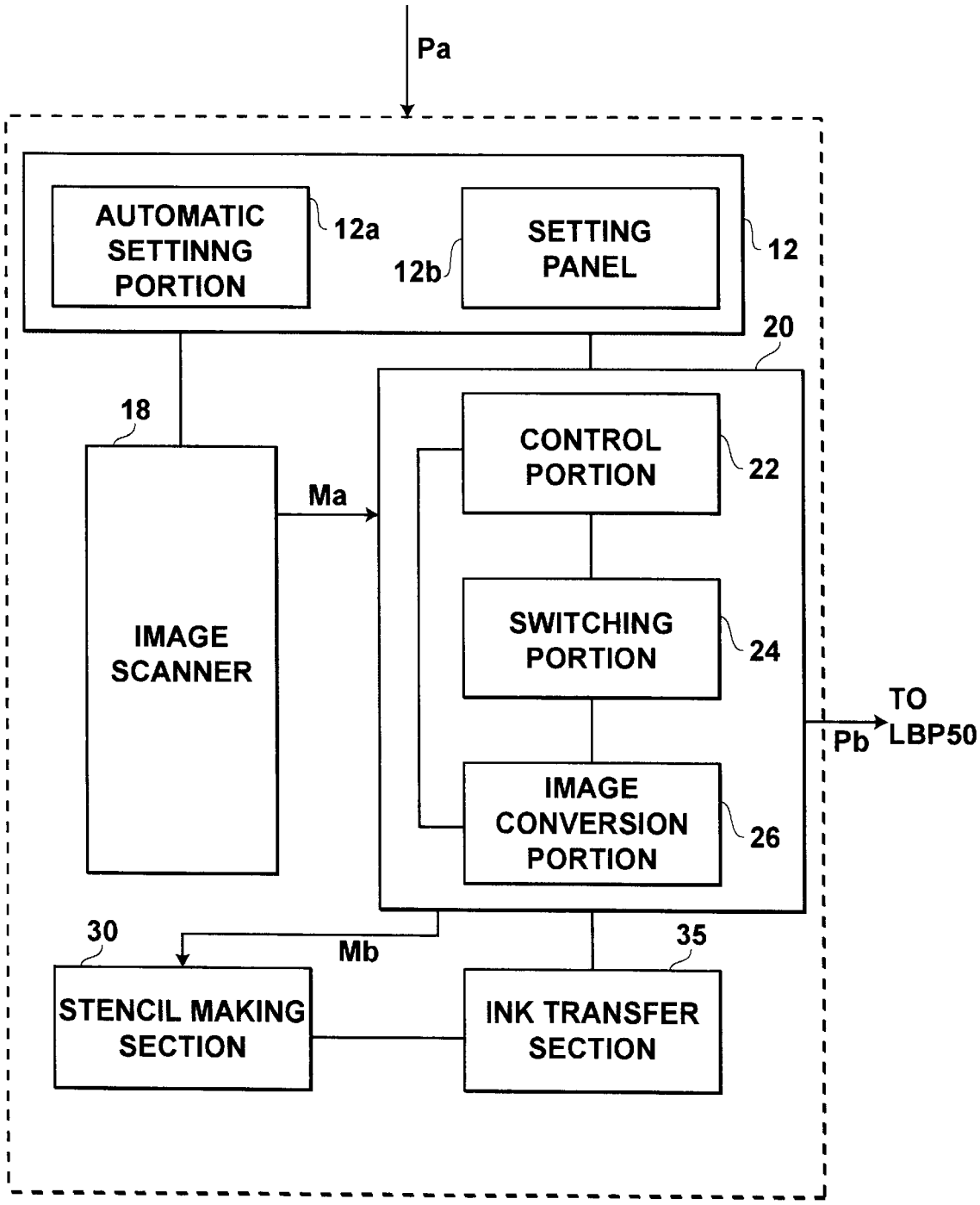
FIG. 2 is a block diagram showing the structure of the stencil printer employed in the print system.
Figure 3:
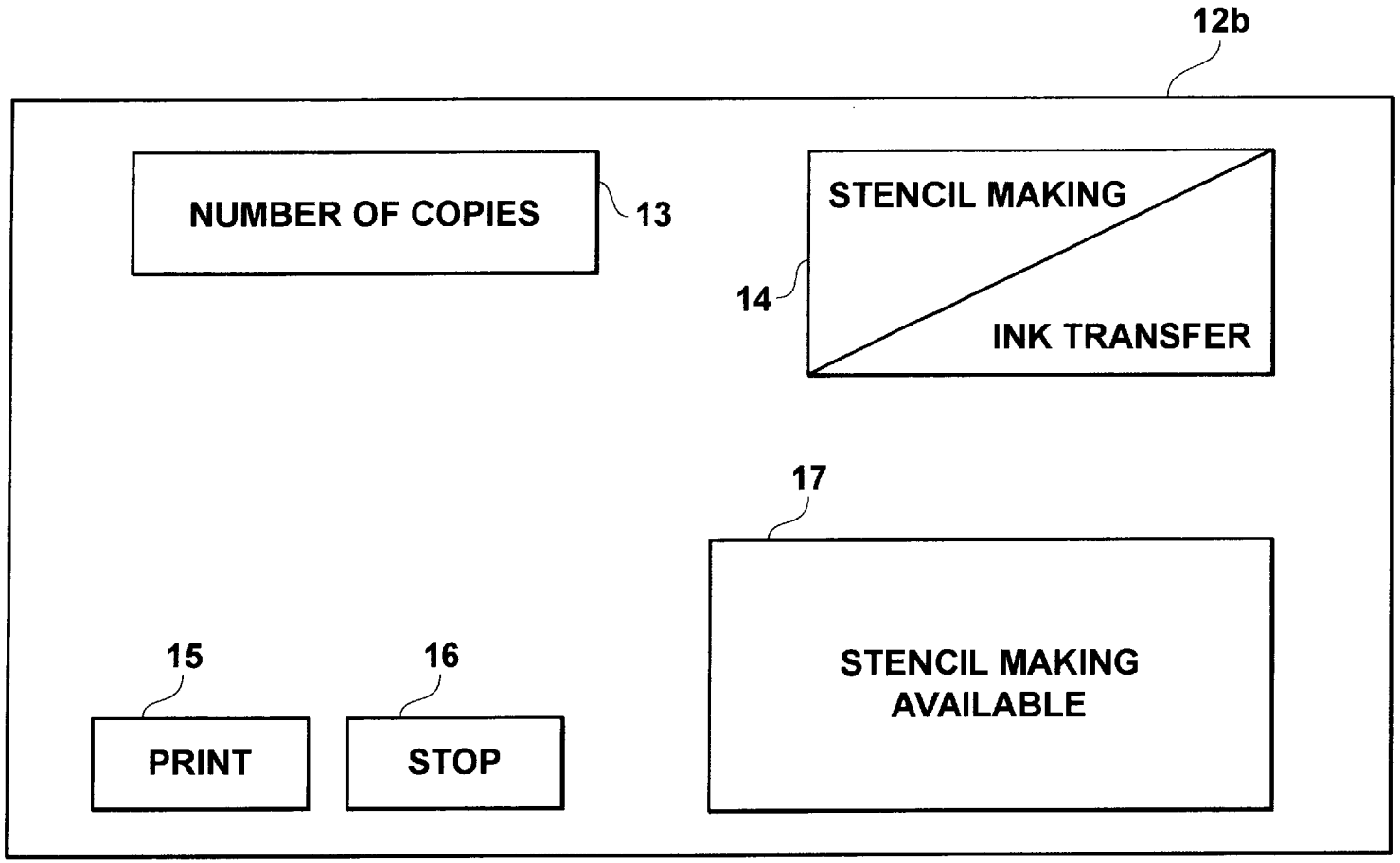
FIG. 3 is a view showing a setting panel of the stencil printer in the print system.

As shown in FIG. 2, the stencil printer 10 comprises a setting section 12 for setting the working mode of the stencil printer 10, the number of copies to be printed and the like and for issuing various directions, e.g., that printing is to be executed and that printing is to be stopped, an image scanner 18 which reads an image on an original and obtains bit map data Ma representing the image, a controller 20, a stencil making section 30 which makes a stencil on the basis of bit map data Mb from the controller 20 and an ink transfer section 35 which transfers ink through the stencil made by the stencil making section 30 and obtains printings. The setting section 12 comprises an automatic setting portion 12*a* which automatically sets the working mode of the stencil printer to a stencil making mode each time it receives a piece of PDL data from the computer 60 or each time the image scanner 18 begins to read the image on an original and to the ink transfer mode when the stencil making section 30 finishes making a stencil, and a setting panel 12*b* for manual setting. As shown in FIG. 3, the setting panel 12*b* comprises a copy number setting portion 13 for setting the number of copies to be printed, a manual mode setting portion 14 for manually setting the working mode of the stencil printer 10, a printing button 15 which is pressed when printing is to be executed, a printing stop button 16 which is pressed when printing is to be stopped and a liquid crystal display 17 which displays a message "stencil making is available" when the working mode is set to the stencil making mode and a message "printing is available" when the working mode is set to the ink transfer mode. The automatic setting portion 12 a normally holds the working mode of the stencil printer 10 to the ink transfer mode so long as the stencil is on the printing drum unless it receives a piece of PDL data from the computer 60 or the image scanner 18 begins to read the image on an original, or the working mode is manually otherwise set through the manual mode setting portion 14. The controller 20 comprises a switching portion 24 which causes the stencil printer 10 to print when the number of copies set is not smaller than a predetermined threshold value (10 in this particular embodiment) and causes the non-stencil printer to print when the number of copies set is smaller than the predetermined threshold value, a control portion 22 which allows the switching portion 24 to act when the stencil printer 10 is in the stencil making mode and inhibits the switching portion 24 from acting when the stencil printer 10 is not in the stencil making mode, and an image conversion portion 26 which, when the stencil printer 10 is selected, converts the PDL data Pa or the bit map data Ma into bit map data Mb conforming to the printing condition set (such as the paper size included in the PDL data or set through the setting panel 12*b*) and outputs the bit map data Mb to the stencil making section 30, and when the laser beam printer 50 is selected, converts the PDL data Pa or the bit map data Ma into PDL data Pb in the page description language of the laser beam printer 50 and outputs the PDL data Pb to the laser beam printer 50. While the switching portion 24 is not acting, the image conversion portion 26 converts the PDL data Pa or the bit map data Ma into bit map data Mb and outputs the bit map data Mb to the stencil making section 30. Though not shown, the image conversion portion 26 is provided with a memory which temporarily stores the PDL data Pa or the bit map data Ma.

Figure 4:
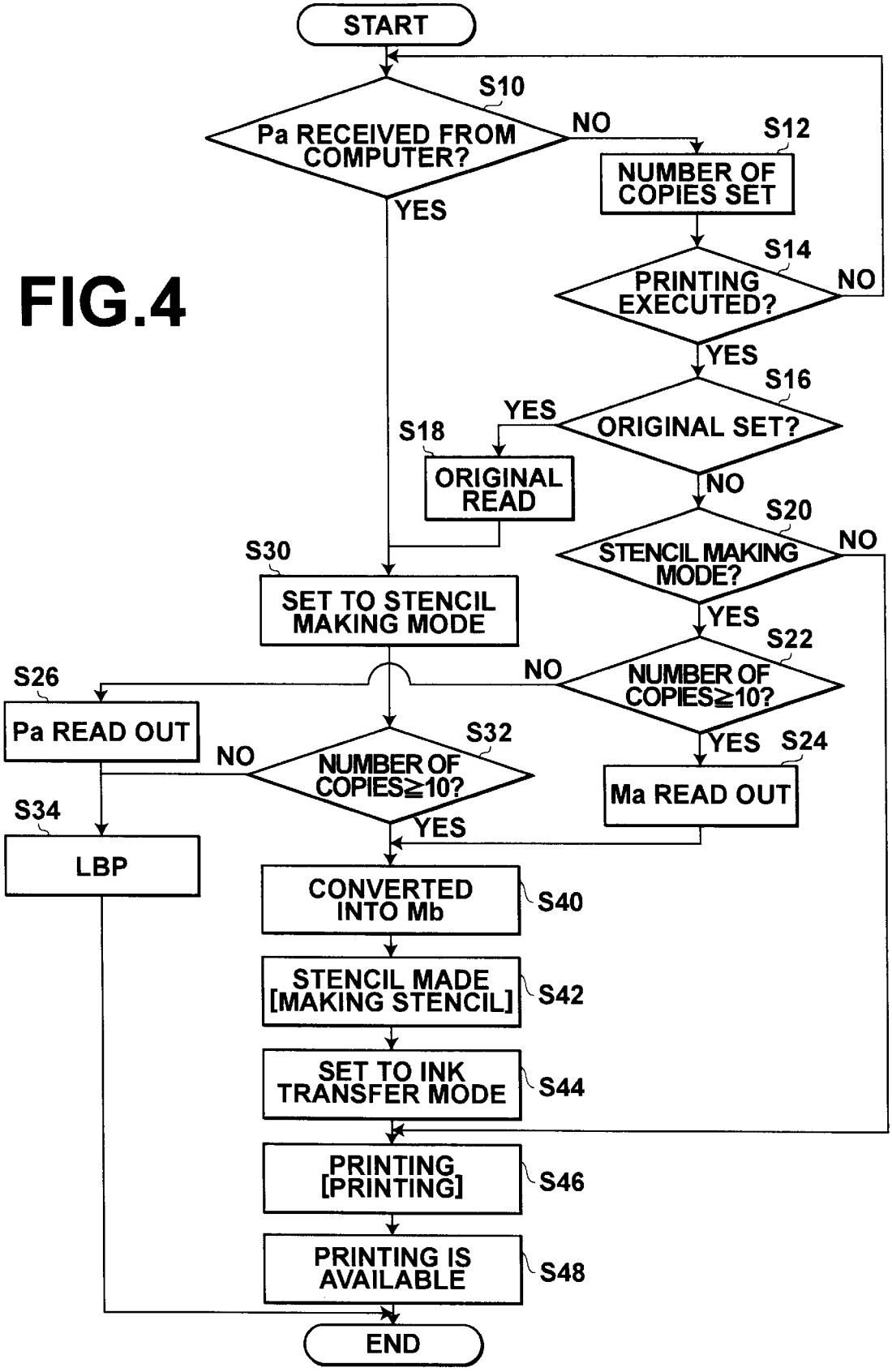
FIG. 4 is a flow chart for illustrating the operation of the stencil printer in the print system shown in FIG. 1.

Operation of the stencil printer 10 of this embodiment in the print system shown in FIG. 1 will be described in detail with reference to the flow chart shown in FIG. 4, hereinbelow. When the stencil printer 10 receives a piece of PDL data Pa from the computer 60 (step S10: YES), the automatic setting portion 12*a* of the stencil printer 10 sets the working mode of the stencil printer 10 to the stencil making mode (step S30). At this time, the liquid crystal display 17 of the setting panel 12*b* displays a message "stencil making is available". Since the stencil printer 10 is in the stencil making mode, the control portion 22 of the controller 20 starts the switching portion 24 and causes the switching portion 24 to select the stencil printer 10 or the laser beam printer 50 according to the number of copies to be printed (step S32). The switching portion 24 reads copy number information from print information included in the PDL data Pa, and when the number of copies to be printed is 10 or more (step S32: YES), the switching portion 24 selects the stencil printer 10, and the image conversion portion 26 converts the PDL data Pa into bit map data Mb and outputs the bit map data Mb to the stencil making section 30 (step S40). The stencil making section 30 makes a stencil on the basis of the bit map data Mb sent thereto (step S42) and when the stencil is finished, the stencil making section 30 outputs a stencil making end signal representing that making the stencil is finished to the setting section 12. While the stencil making section 30 is making the stencil, the liquid crystal display 17 displays a message "making stencil". Upon receipt of the stencil making end signal, the automatic setting portion 12*a* of the setting section 12 sets the working mode of the stencil printer 10 to the ink transfer mode (step S44) and the ink transfer section 35 transfers ink to the printing paper through the stencil made by the stencil making section 30, thereby printing the image represented by PDL data Pa (step S46). When copies of a number designated by the copy number information are printed, the action of the stencil printer 10 is stopped. While the ink transfer section 35 is transferring ink, the liquid crystal display 17 displays a message "printing", and when printing of the designated number of copies is ended, the liquid crystal display 17 changes the message to "printing is available" to indicate that the stencil printer 10 is in the ink transfer mode.

Whereas, when the number of copies to be printed is smaller than 10 (step S32: NO), the switching portion 24 selects the laser beam printer 50, and the image conversion portion 26 converts the PDL data Pa into PDL data Pb and outputs the PDL data Pb to the laser beam printer 50 (step S34).

PDL data Pa sent from the computer 60 is temporarily stored in the memory of the image conversion portion 26.

Operation of the stencil printer 10 when instruction to print is issued from the stencil printer 10 itself will be described, hereinbelow. Except when the stencil printer 10 receives PDL data (step S10: NO), printing is performed by issuing instruction to print through the stencil printer 10 itself. That is, the user first sets the number of copies to print (step S12) and pushes the printing button 15 in the setting panel 12*b* (step S14: YES). Then the image scanner 18 checks whether an original has been set (step S16). When it is determined in step S16 that no original has been set, that is, the printing button 15 is pushed with no original set (step S14: YES, Step S16: NO), which means that additional copies of the image which has been printed in the just preceding printing process are to be printed, the stencil printer 10 proceeds to step S20 to execute additional printing process, whereas when it is determined in step S16 that an original has been set (Step S16: YES), the image scanner 18 reads the original and outputs bit map data Ma to the controller 20 (step S18). Then the bit map data Ma is processed in the same manner as the PDL data Pa sent from the computer 60 except the number of copies (when the printing button 15 is pushed before setting the number of copies, the number of copies is automatically set to 1, default) in step S30 and the following steps.

In the additional printing process executed in step S20 and the following steps, the control portion 22 of the controller 20 first determines whether the stencil printer 10 is in the stencil making mode (step S20). When the working mode of the stencil printer 10 is the stencil making mode, that is, when the preceding stencil has been unwound from the printing drum or when the user has manually set the working mode of the stencil printer 10 to the stencil making mode through the manual mode setting portion 14, the control portion 22 of the controller 20 activates the switching portion 24 to select the printer. When the number of copies to be printed is not smaller than 10 (step S22: YES), the switching portion 24 selects the stencil printer 10 and the image conversion portion 26 reads out the preceding data (PDL data Pa or bit map data Ma) from the memory (step S24). Then the image conversion portion 26 converts the preceding data to bit map data Mb and outputs the bit map data Mb to the stencil making section 30 (step S40).

When the number of copies to be printed is smaller than 10 (step S22: NO), the switching portion 24 selects the laser beam printer 50 and the image conversion portion 26 reads out the preceding data (PDL data or bit map data Ma) from the memory (step S26). Then the image conversion portion 26 converts the preceding data to PDL data Pb written in the page description language of the laser beam printer 50 and outputs the PDL data Pb to the laser beam printer 50 (step S34).

Whereas, when it is determined in step S20 that the working mode of the stencil printer 10 is the ink transfer mode, which means that additional copies of the image which has been printed by the stencil printer 10 on the basis of PDL data or bit map data Ma in the just preceding printing process are to be printed, the control portion 22 does not activate the switching portion 24 and the ink transfer section 35 prints a set number of copies using the stencil wound around the printing drum (step S46).

In the stencil printer of this embodiment, the stencil printer 10 and the laser beam printer 50 can be selectively used according to the number of copies to be printed. At the same time, the stencil printer 10 can be used irrespective of the number of copies to be additionally printed so long as the stencil for the copies is still wound around the printing drum, whereby additional copies can be printed at lower cost.

Though the present invention has been described on the basis of an embodiment, the present invention can be embodied in other various ways.

For example, though, in the embodiment described above, only one non-stencil printer (the laser beam printer 50) is incorporated in the print system together with the stencil printer 10 of the present invention, two or more non-stencil printers may be incorporated in the print system. In this case, it is possible to arrange the system so that the non-stencil printer which is used in place of the stencil printer when the number of copies is small can be set.

Though, in the embodiment described above, the stencil printer 10 is connected to the laser beam printer 50 by way of a network, the stencil printer 10 may be connected to the laser beam printer 50 by way of another external interface such as a parallel cable.

Though, in the embodiment described above, the stencil printer 10 and the non-stencil printer (laser beam printer 50)

are separately provided and connected by way of an external interface, they may be contained in a housing and connected through an internal interface.

What is claimed is:

1. A stencil printer which can be linked with a non-stencil printer comprising a copy number setting means for setting a number of copies to be printed, a working mode setting means for setting the working mode of the stencil printer to a stencil making mode or an ink transfer mode, a stencil printing means consisting of a stencil making section which makes a stencil when the working mode of the stencil printer is set to the stencil making mode by the working mode setting means and an ink transfer section which transfers ink to a printing paper through the stencil made by the stencil making section when the working mode of the stencil printer is set to the ink transfer mode by the working mode setting means, and a printer switching means which causes the stencil printing means to print when the number of copies set by the copy number setting means is not smaller than a predetermined threshold value and causes the non-stencil printer to print when the number of copies set by the copy number setting means is smaller than the predetermined threshold value, wherein the improvement comprises a switching inhibiting means which inhibits the printer switching means from switching between the stencil printing means and the non-stencil printer when the working mode of the stencil printer is the ink transfer mode.

* * * * *